US009199470B2

(12) United States Patent
Hu et al.

(10) Patent No.: US 9,199,470 B2
(45) Date of Patent: Dec. 1, 2015

(54) CLEANING APPARATUS FOR INKJET PRINT HEAD

(71) Applicant: National Chiao Tung University, Hsinchu (TW)

(72) Inventors: Jwu-Sheng Hu, Hsinchu (TW); Hsien-Tang Jao, Hsinchu County (TW)

(73) Assignee: NATIONAL CHIAO TUNG UNIVERSITY, Hsinchu (TW)

( * ) Notice: Subject to any disclaimer, the term of this patent is extended or adjusted under 35 U.S.C. 154(b) by 0 days.

(21) Appl. No.: 14/256,526

(22) Filed: Apr. 18, 2014

(65) Prior Publication Data

US 2015/0210079 A1 Jul. 30, 2015

(30) Foreign Application Priority Data

Jan. 27, 2014 (TW) ..... 103102872 A

(51) Int. Cl.
*B41J 29/38* (2006.01)
*B41J 2/165* (2006.01)

(52) U.S. Cl.
CPC ..... *B41J 2/16579* (2013.01)

(58) Field of Classification Search
USPC ..... 347/14, 15, 19, 5, 9
See application file for complete search history.

(56) References Cited

U.S. PATENT DOCUMENTS

2006/0187253 A1* 8/2006 Sato et al. ..... 347/15

* cited by examiner

*Primary Examiner* — Lam Nguyen
(74) *Attorney, Agent, or Firm* — Bacon & Thomas, PLLC

(57) ABSTRACT

In the present invention, an inkjet printing head cleaning device is provided, through droplet image information and feedback control technology in order to drive the nozzle without ejecting, the micro clogging technique is able to avoid the nozzle crimp and reduce the material cost.

8 Claims, 11 Drawing Sheets

CLEANING APPARATUS FOR INKJET PRINT HEAD

BACKGROUND OF THE INVENTION

1. Field of the Invention

The present invention relates to an inkjet printing head cleaning device and the cleaning method thereof, more particularly to an inkjet printing head using the image capturing unit to capture the image of the inkjet print head, in order to control the of the micro disturbance state at real time, and in order to compensate the variation of the inkjet print head.

2. Description of the Prior Art

The industrial inkjet printing technology can be used for manufacturing the TFT transistor, the 3D printer, the solar cell electrode, and biomedical chip enzyme printing process etc. At present, the inkjet print head should be cleaned and calibrated before printing. How to maintain fully printing function after the rest of inkjet print head for a certain time has become an important research topic of the printing process. Recently, the advanced development of 3D printing technology has been considered as the third industrial revolution by the US President Obama. Except depending on the advancement of material science, the development of 2D or 3D printing technology should be focused on the driving technology of the inkjet print head, in order to obtain good printing quality.

Regarding the driving method for cleaning the inkjet print head at present, the amplitude of driving voltage is changed to control the deformation of piezoelectric film in the inkjet print head mainly. Through the micro disturbance behavior of the piezoelectric film, the ink in nozzle will not be solidified even the inkjet print head is at the rest state, so that the nozzle crimp will not be occurred.

At present, there is no good solution for the best micro disturbance driving waveform of the inkjet print head. The problems derived from current technology are:

(1) If the driving voltage is too large, the piezoelectric behavior will be generated to form the droplet, which will cause the waste of materials.

(2) If the driving voltage is too small, it will be unable to know the state of nozzle plate.

(3) If the driving voltage is small and the frequency is high, the droplet will probably be squeezed to form the unnecessary waste. (4) The best waveform will be changed due to the variation of inkjet print head during printing process.

The driving technology of the inkjet print head associated with different ink viscosity and printing characteristics has been developed to a certain degree. When the pre-printing material is filled in the inkjet print head for heating, the ink solidification or the nozzle crimp may be occurred due to uneven heating or ink characteristics. How to keep ready ink in the nozzle has become an important research topic of the printing process.

SUMMARY OF THE INVENTION

Accompanying with relevant development of modern science technology and material science, the industrial printing technology has become one of focal points for research and development of advanced process technology gradually, such as the 3D printer, PCB legend printer, and TFT printing process etc. In order to response different application, different material should be filled in the inkjet print head. In the invention, the printing time of nozzle is adjusted through controlling the driving voltage and the image feedback mechanism, in order to avoid the nozzle crimp and reduce the material cost.

Through the image processing and image identifying technology, the present invention uses the image capturing unit (charge coupling element) to capture the state of nozzle plate on the inkjet print head, and feeds back to the controller for conducting switch control decision, and generates the best switching strategy of disturbance switch. Due to real-time feedback on line, the compensation can be conducted corresponding to the variation of the inkjet print head.

Thus, a purpose of the present invention is to provide an inkjet printing head cleaning device, comprising an inkjet printing head unit, an inkjet printing head driving unit, an image capturing unit, a memory unit, and a control unit. The inkjet printing head unit comprises a nozzle, and a droplet is ejected from the nozzle. The inkjet printing head driving unit is connected to the inkjet printing head unit for controlling the open or the close of the nozzle. The image capturing unit captures an image of the nozzle, to obtain the actual nozzle information, or the nozzle ejects an image of the droplet, to obtain the actual droplet image, information, wherein the actual droplet image information is the length from the droplet to the nozzle, or the diameter of the droplet. The memory unit memorizes the actual droplet image information and the desired droplet information. The control unit is connected to the inkjet printing head driving unit, the image capturing unit, and the memory unit. The control unit judges the difference between the actual droplet image information and the desired droplet image information in accordance with the actual droplet image information of the image capturing unit, in order to the open or close of the nozzle by the inkjet printing head driving unit, so that the length from the droplet to the nozzle is equivalent to the desired value, or the diameter of the droplet is equivalent to the desired value.

The control unit is the proportion, proportion-differentiation, proportion-integration-differentiation controller, back propagation network, or neural network controller.

The inkjet printing head driving unit is the air power switching loop, or the electric driving switching loop with a channel.

The image capturing unit comprises a flashing light device and a digital signal processor, wherein the flashing light device provides a light source to the image capturing unit, and the digital signal processor processes the image to capture the actual droplet image information or the actual nozzle information. The color for the light source of flashing light device is the red, green, blue or white or their combination. The light source of flashing light device is the light emitting diode, magnesium light or tungsten light.

The inkjet printing head unit further comprises a nozzle plate. The control unit transmits the voltage of the inkjet printing head unit by controlling the inkjet printing head driving unit, in order to control the simultaneous deformation of nozzle plate, to control the droplet ejected by the nozzle, so that the length is equivalent to the desired value, or the diameter is equivalent to the desired value. The control unit creates a second-order curve in accordance with the actual droplet image information, and obtains the maximum value of the actual droplet image information in accordance with the second-order curve.

The memory unit further comprises a desired nozzle plate information, a desired deformation information, an actual deformation information or an actual nozzle plate information and an actual information.

The actual nozzle plate information and the desired nozzle plate information comprise the image information of nozzle plate, the temperature information of nozzle plate, the pressure information of nozzle plate, the diameter of nozzle plate, and the grey scale of nozzle plate. The actual deformation information is the nozzle plate deformation information controlled by the control unit. The desired nozzle plate information and the desired deformation information are inputted and stored in the memory unit. The inkjet printing head driving unit controls the open/close pulses of the nozzle in accordance with the maximum length from the droplet to the nozzle, or the maximum diameter the droplet, wherein the open/close pulses are $2^n$. The control unit controls the inkjet printing head driving unit to control open or close of the nozzle in accordance with the image of droplet captured by the image capturing unit, until the actual droplet image information is modified to the maximum value.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENT

Regarding the inkjet printing head cleaning device provided by the present invention, the technical content, characteristics and performance will be revealed clearly in the following preferred embodiment.

The piezoelectric inkjet print head has high voltage and low current capacity load, which is suitable for the 3D printer, PCB legend printer, and TFT printing process etc. As for the inkjet print head, except controlling the printing precision, there is another important issue: "How to maintain fully printing function of the inkjet at any time when different material is filled in the inkjet print head". This article proposes an image processing technology. The switch control signal of the piezoelectric film is adjusted in accordance with the droplet state on nozzle plate, in order to maintain fully printing function of the inkjet at any time, and avoid the ink solidification in the inkjet print head at rest. Through the micro disturbance technique, the droplet will not be ejected upon calibrating the inkjet print head, so that the consumption of ink will be saved effectively.

Figure 1:
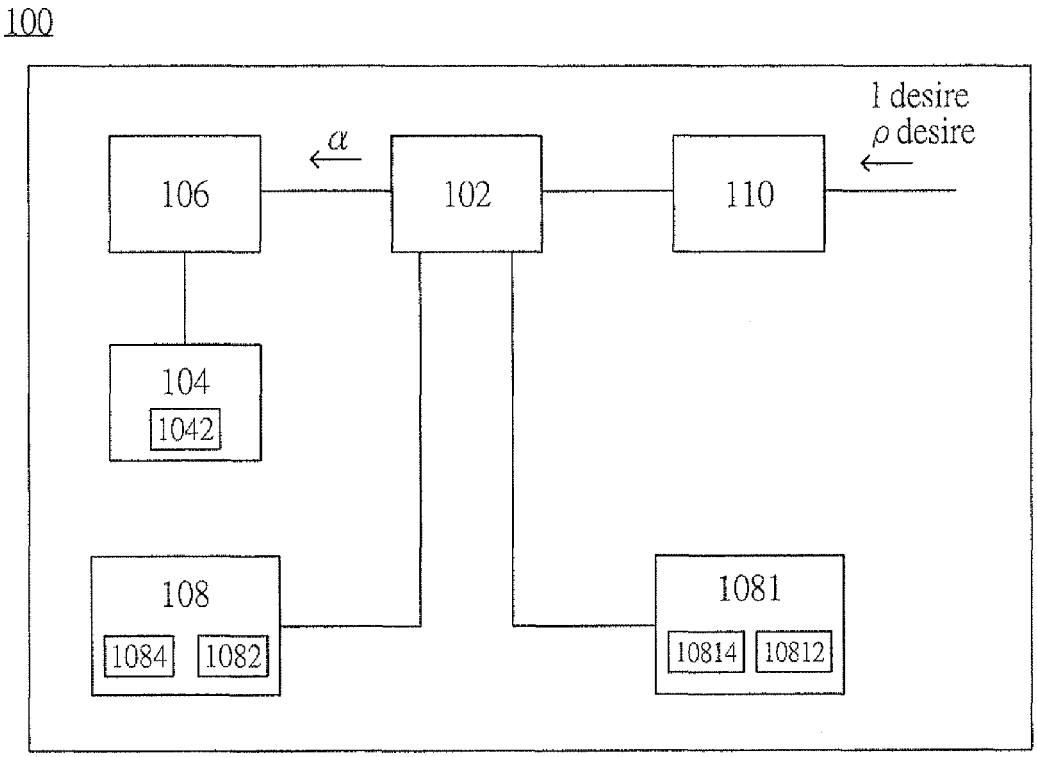
FIG. 1 illustrates the diagram of the inkjet printing head cleaning device.

The present invention provides an inkjet printing head cleaning device 100, and the structure is illustrated in FIG. 1. FIG. 1 illustrates the diagram of the inkjet printing head cleaning device. Through this system, the user can avoid the nozzle crimp of the inkjet print head due to it is rest for a long time. In addition, the calibration speed of the inkjet print head can be increased at the initial state of the inkjet printing device. The inkjet printing head cleaning device 100 comprises a control unit 102, an inkjet printing head unit 104, a nozzle 1042, an inkjet printing head driving unit 106, an image capturing unit 108, and a memory unit 110.

Figure 2:
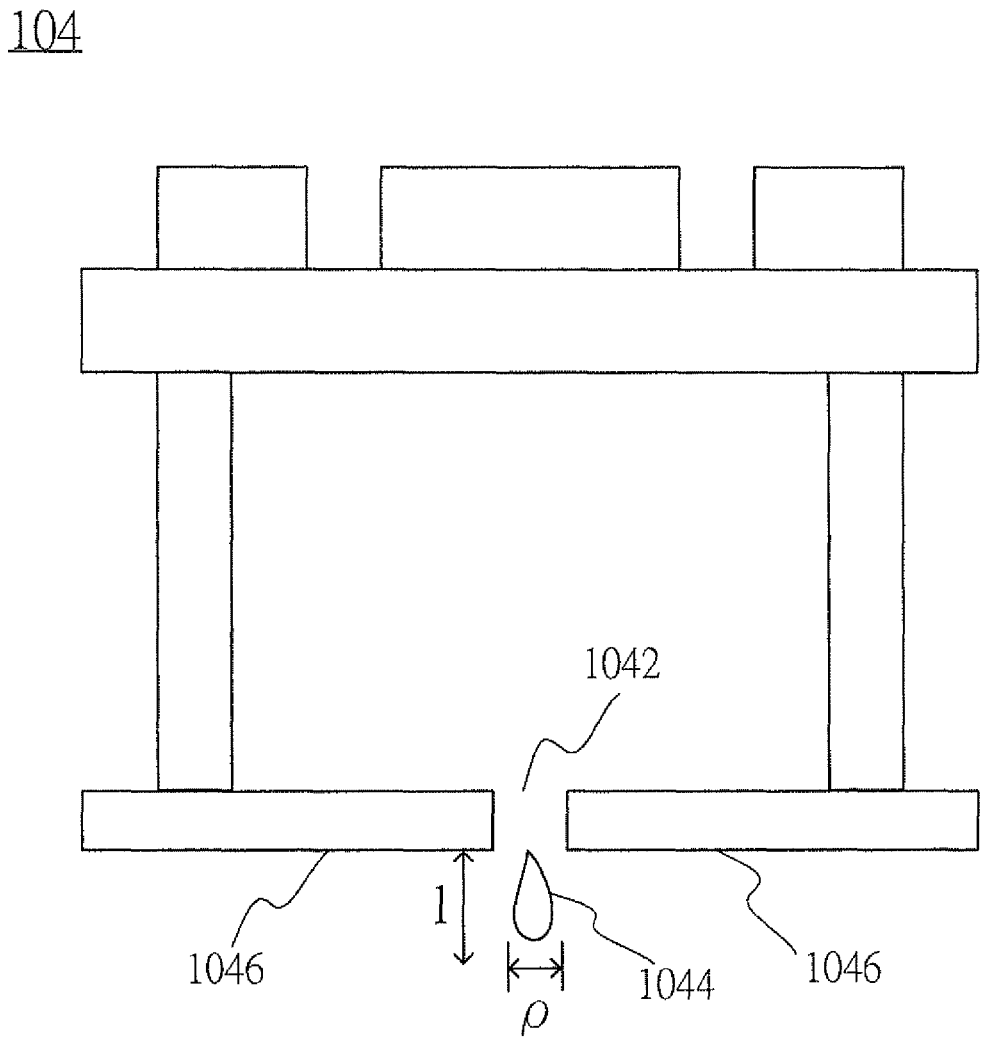
FIG. 2 illustrates the diagram of the inkjet printing head unit.

Please still refer to FIG. 1. FIG. 2 illustrates the diagram of the inkjet printing head unit. The inkjet printing head unit 104 comprises a nozzle 1042, wherein the droplet 1044 is injected through the nozzle 1042. The inkjet printing head driving unit 106 is connected to the inkjet printing head unit 104, in order to control the open or the close of the nozzle 1042. The image capturing unit 108 captures an image (not shown in Figure) from the nozzle 1042, in order to obtain the actual nozzle information. At least an image of droplet from the nozzle 1042 can also be captured by the image capturing unit 108, in order to obtain the actual nozzle information. Wherein, the actual droplet image information is the length from the droplet 1044 to the nozzle 1042, or the diameter of the droplet 1044.

Please refer to FIG. 2. The inkjet printing head unit 104 comprises a nozzle plate 1046. The control unit 102 transmits the voltage of the inkjet printing head unit 104 by controlling the inkjet printing head driving unit 106, in order to control the simultaneous deformation of nozzle plate 1046, to control the droplet 1044 ejected by the nozzle 1042, so that the length of droplet 1044 is equivalent to the desired value, or the diameter of droplet 1044 is equivalent to the desired value.

Please refer to FIG. 1. In this embodiment, the image capturing unit 108 comprises a flashing light device 1082 and a digital signal processor 1084, wherein the flashing light device 1082 provides a light source required by the image capturing unit 108. The digital signal processor 1084 analyzes and processes at least an image of the nozzle 1042 captured from the image capturing unit 108, in order to obtain the actual droplet image information or the actual nozzle information of the droplet 1044.

Please refer to FIG. 2. The image capturing unit 108 and the image capturing unit 1081 are used to capture the image information of the droplet 1044 from the inkjet printing head unit 104. The image capturing unit 108 is used to capture the diameter of the droplet 1044 from the inkjet printing head unit 104. The image capturing unit 1081 is used to capture the length information of the droplet 1044 from the nozzle plate 1046. Both information are used as the feedback signal to adjust the best driving state of switch. The light source of flashing light device 1082, 10812 is the red, green, blue or white or their any combination. The light source of flashing light device 1082, 10812 is the light emitting diode, magnesium light or tungsten light.

Please refer to FIG. 1. The memory unit 110 memorizes the actual droplet image information and the desired droplet image information. The memory unit 110 further memorizes the desired nozzle plate information, the desired deformation information, the actual deformation information, the actual nozzle plate information and the actual deformation information. The actual nozzle plate information and the desired nozzle plate information comprise (see FIG. 2) the image information of nozzle plate 1046, the temperature information of nozzle plate, the pressure information of nozzle plate 1046, the diameter of nozzle plate 1046, and the grey scale of nozzle plate 1046. The actual deformation information is the nozzle plate 1046 deformation information controlled by the control unit 102.

Figure 4:
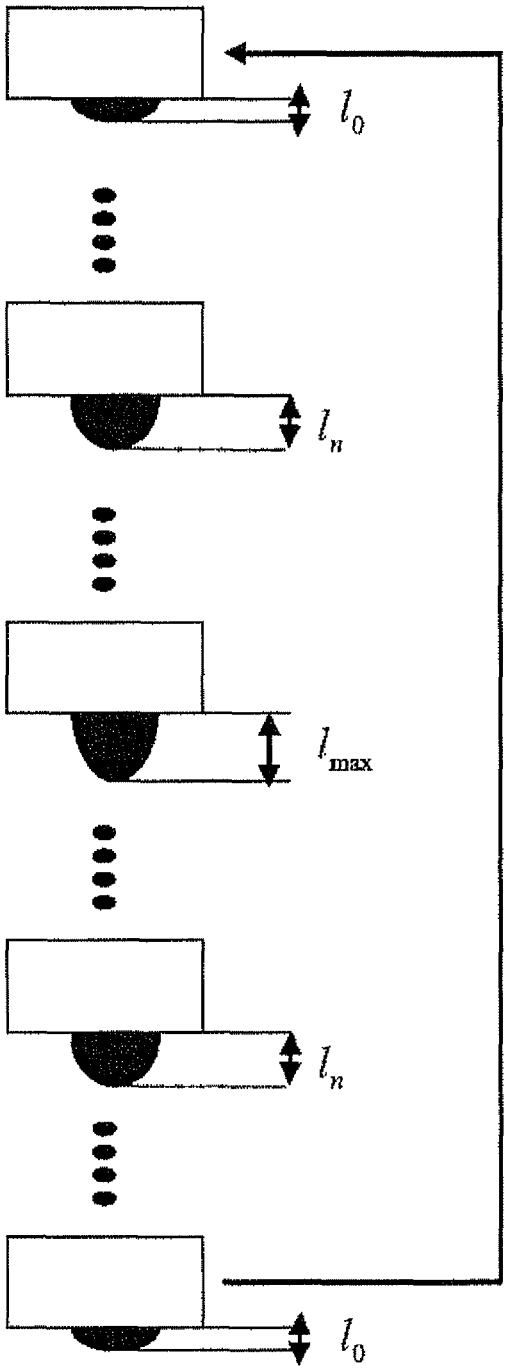
FIG. 4 illustrates the diagram of the length from the droplet to the nozzle.
Figure 5:
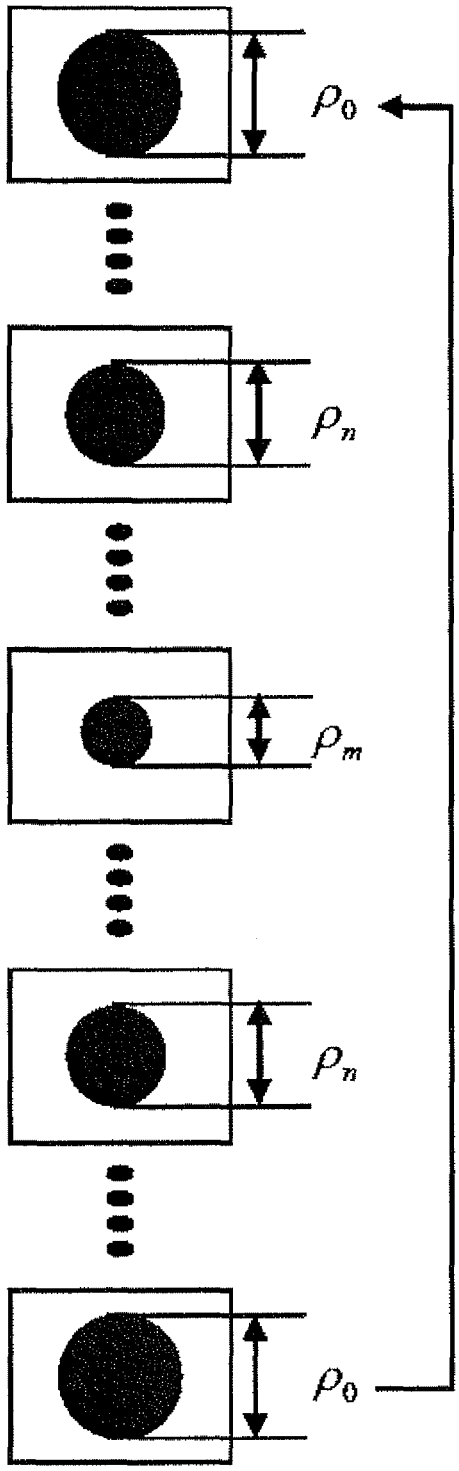
FIG. 5 illustrates the diagram the diameter of the droplet.
Figure 6:
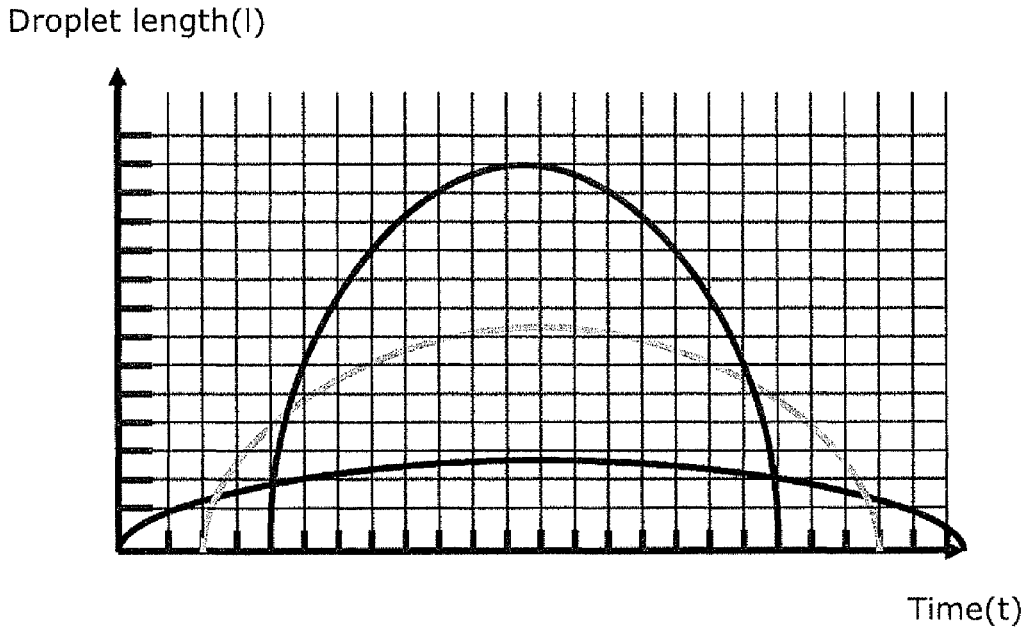
FIG. 6 illustrates the variation curve of the length from the droplet to the nozzle.

Please still refer to FIG. 1. The image capturing unit 108 is able to capture the simultaneous image of the droplet 1044, and analyze to obtain the actual droplet image information (the length ratio σ from the droplet 1044 to the nozzle 1042 or the diameter ratio γ of the droplet 1044, wherein the length from the droplet to the nozzle is $l_0$, $l_n$, $l_{max}$, and the diameter of the droplet is $\rho_0$, $\rho_n$, $\rho_{min}$). FIG. 4 illustrates the diagram of the length from the droplet to the nozzle and FIG. 5 illustrates the diagram the diameter of the droplet. Its deformation will have different result due to the adjustment of the switching control strategy. FIG. 6 illustrates the variation curve of the length from the droplet to the nozzle.

Please refer to FIG. 1. The control unit 102 is connected to the inkjet printing head driving unit 106, the image capturing unit 108, and the memory unit 110. The control unit 102 judges the difference between the actual droplet image information and the desired droplet image information in accordance with the actual droplet image information of the image capturing unit 108. The control unit 102 controls the inkjet printing head driving unit 106 in accordance with the difference between the actual droplet image information and the desired droplet image information, in order to control the open or close of the nozzle 1042, so that the length l from the droplet 1044 to the nozzle 1042 (as shown in FIG. 2) is equivalent to the desired length value $l_{desire}$, or the diameter ρ of the droplet 1044 is equivalent to the desired diameter value $\rho_{desire}$. The inkjet printing head driving unit 106 controls the open/close pulses of the nozzle 1042 in accordance with the maximum length $l_{max}$ from the droplet 1044 to the nozzle 1042, or the maximum diameter ρ of the droplet 1042, wherein the open/close pulses of the nozzle 1042 are $2^n$.

Please refer to FIG. 1. After the desired length value $l_{desire}$ and the desired diameter value $\rho_{desire}$ information of the droplet 10 are obtained, the control unit 102 carries out the analysis of control strategy, and generate the switching control strategy α for the length l and the diameter ρ of the corresponding droplet 1044, where the switching control strategy α=(Number of open pulses)/(Number of open pulses). When the switching control strategy is adjusted by the control unit 102, the maximum length $l_{max}$ and the maximum diameter $\rho_{max}$ are set at $2^n$ in advance.

Figure 3:
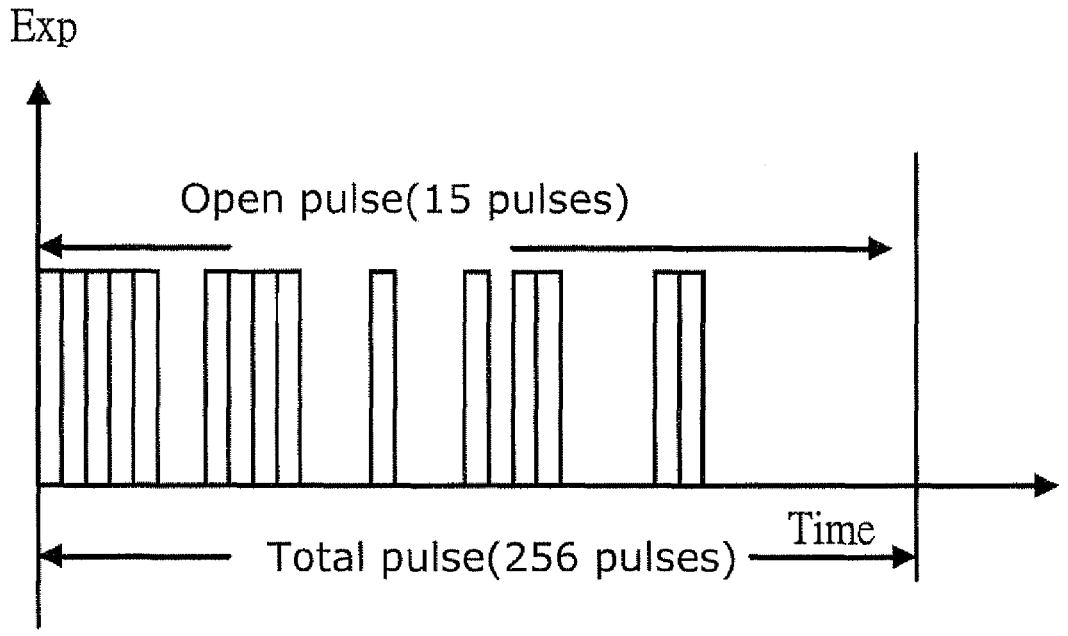
FIG. 3 illustrates the diagram of the open/close pulses.

Please refer to FIG. 3. FIG. 3 illustrates the diagram of the open/close pulses. In this embodiment, the maximum total pulse are 256. If the open/close pulses are 256, the maximum length $l_{max}$ or the maximum diameter $\rho_{max}$ can be achieved. If the open/close pulse is at least 1, the minimum length $l_{min}$ or the minimum diameter $\rho_{min}$ can be achieved. In time t, if $l_{desired\ level15}$ or $\rho_{desired\ level15}$ is desired, then $$\left(l_{desired\ level15} = \frac{15}{256} \times l_{max} \text{ or } \rho_{desired\ level15} = \frac{15}{256} \times \rho_{max}\right)$$

required by the user can be achieved.

Please still refer to FIG. 1. The inkjet printing head driving unit 106 of the present invention can be the air power switching loop, or the electric driving switching loop with at least a channel.

Figure 7:
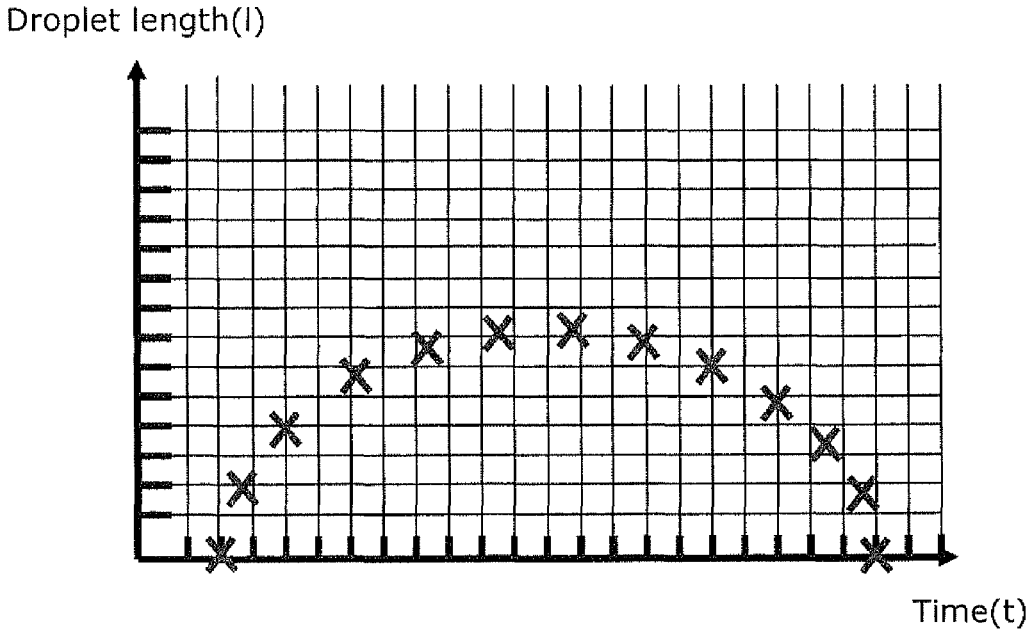
FIG. 7 illustrates the variation curve of the droplet length.
Figure 8:
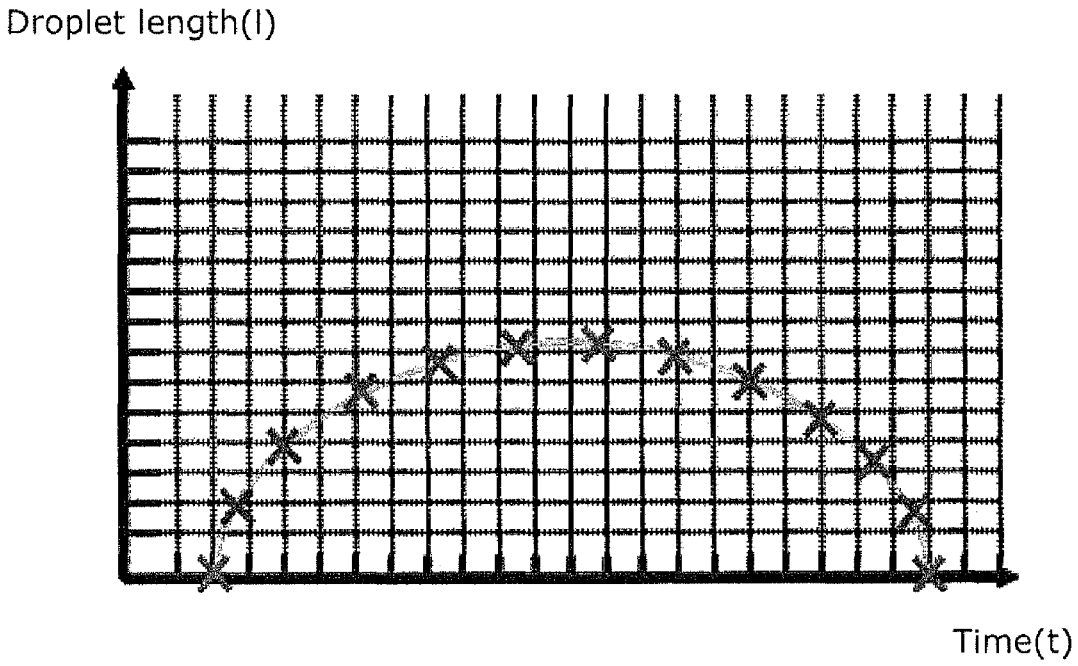
FIG. 8 illustrates the second-order curve of the droplet length.

Please refer to FIG. 7, the length is used as an example for the description. FIG. 7 illustrates the variation curve of the droplet length. Assume if the frame rate of the image capturing unit 108 is 13 (frame/sec), then at 1 second, 13 length image information from the droplet 1044 to the nozzle 1042 will be obtained. The control unit 102 receives the actual droplet image information of the image capturing unit 108, and draws the droplet image information into this variation curve of the droplet length. It is noted that in these 13 information, the required image information ($l_0$, $l_{max}$) might not be obtained because the frame rate is too low. The control unit 102 has to use these 13 known actual droplet image information (the droplet length, time) to carry out the curve fitting and create a second-order equation ($y=ax^2+bx+c$ ($a\neq0$)) of curve, in order to obtain the second-order curve for the length of the droplet 1044 as shown in FIG. 8.

Figure 9:
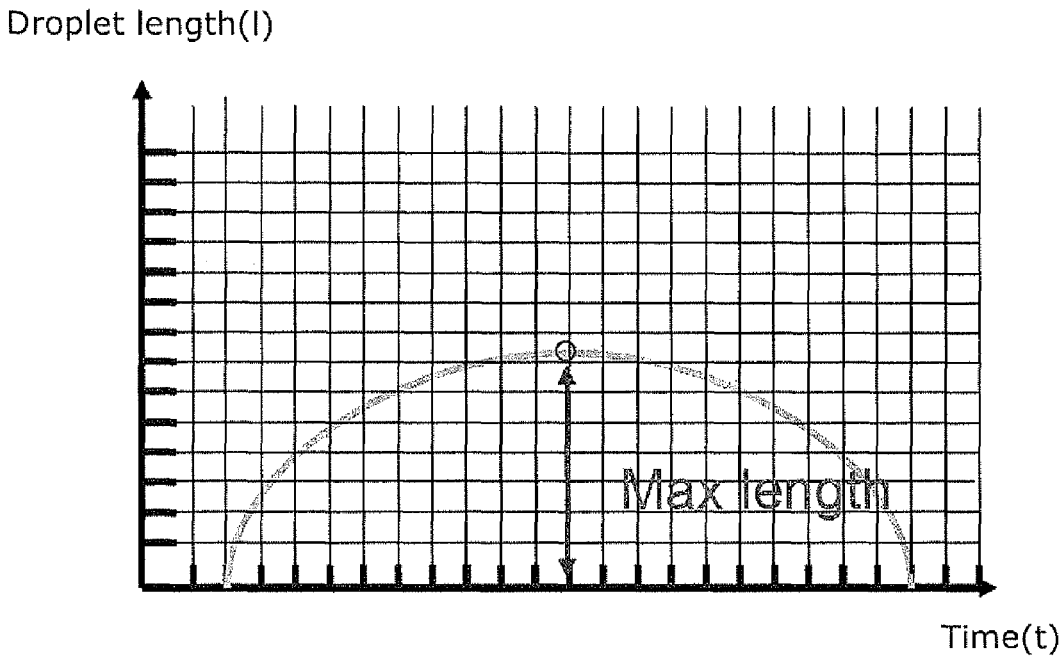
FIG. 9 illustrates the diagram for maximum length of the actual droplet image information.

Please refer to FIG. 1. The control unit 102 creates a second-order equation in accordance with the actual droplet image information, and obtains a maximum value (the maximum length ratio σ from the droplet 1044 to the nozzle 1042) of the actual droplet image information in accordance with the second-order equation, as shown in FIG. 9.

Figure 10:
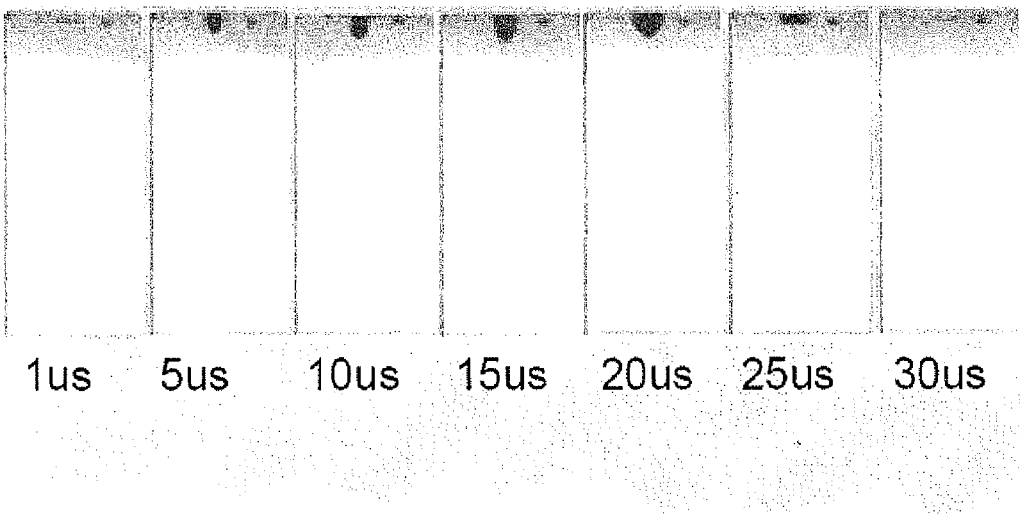
FIG. 10 illustrates image diagram for the best compression or stretching state of the droplet.
Figure 11:
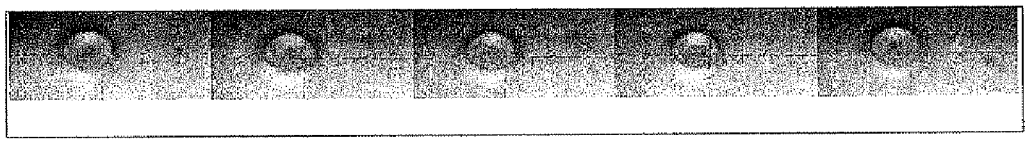
FIG. 11 illustrates image diagram for the best compression or stretching state of the droplet.

Please still refer to FIG. 1. The control unit 102 can obtain the length ratio σ from the droplet 1044 to the nozzle 1042 in accordance with the image of droplet 1044 captured by the image capturing unit 108. After it is known, the length ratio error value $\sigma_{error}$ ($=\sigma_{desired}-\sigma$) can be calculated. The control unit 102 can correct the length ratio error value $\sigma_{error}$, in order to control the inkjet printing head driving unit 106 for controlling the open or the close of the nozzle 1042. This correction will be repeated until the actual droplet image information of the droplet 1044 is corrected to a maximum value (the maximum length ratio σ from the droplet 1044 to the nozzle 1042 or the maximum diameter ratio γ of the droplet 1042). The best compression or stretching state $\sigma_{desired}-\sigma=0$ or $\gamma_{desired}-\gamma=0$ of the droplet 1044 will be obtained, as shown in FIG. 10. FIG. 11 illustrates image diagram for the best compression or stretching state of the droplet.

Please refer to FIG. 1. It is noted that the control unit 102 is the proportion, proportion-differentiation, proportion-integration-differentiation controller, back propagation network, or neural network controller.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. An inkjet printing head cleaning device having an image capturing unit, comprising:

an inkjet printing head unit, said inkjet printing head unit having a nozzle, and at least a droplet is ejected from said nozzle, wherein said inkjet printing head unit comprises a nozzle plate, a control unit transmits a voltage of said inkjet printing head unit by controlling a inkjet printing head driving unit, in order to control a simultaneous deformation of nozzle plate, to control said droplet ejected by said nozzle, so that a length is equivalent to a desired value, or a diameter is equivalent to said desired value;

said inkjet printing head driving unit is connected to said inkjet printing head unit for controlling an open or a close of said nozzle, wherein said inkjet printing head driving unit controls an open/close pulses of the nozzle in accordance with a maximum length from said droplet to said nozzle, or a maximum diameter said droplet, wherein said maximum total pulse of said open/close pulses are 256, said inkjet printing head driving unit is selected from the group consisting of an air power switching loop, and an electric driving switching loop with at least a channel;

an image capturing unit, said image capturing unit captures at least an image of said nozzle, to obtain an actual nozzle information, or said nozzle ejects at least an image of said droplet, to obtain an actual droplet image information, wherein said actual droplet image information is a length from said droplet to said nozzle, or a diameter of said droplet;

a memory unit, said memory unit memorizes said actual droplet image information and a desired droplet information; and a control unit, said control unit is connected to said inkjet printing head driving unit, an image capturing unit, and a memory unit, said control unit judges a difference between said actual droplet image information, wherein said control unit is selected from the group consisting of proportion, a proportion-differentiation, proportion-integration-differentiation controller, back propagation network, and neural network controller, said control unit controls said inkjet printing head driving unit to control open or close of said nozzle in accordance with an image of said droplet captured by said image capturing unit, until said actual droplet image information is modified to a maximum value, said control unit creates a second-order equation in accordance with said actual droplet image information, and obtains a maximum value of said actual droplet image information in accordance with said second-order equation, and said desired droplet image information in accordance with said actual droplet image information of said image capturing unit, in order to said open or said close of said nozzle by said inkjet printing head driving unit, so that said length from said droplet to said nozzle is equivalent to a desired value, or a diameter of said droplet is equivalent to said desired value.

2. The device according to claim 1, wherein said memory unit further comprises a desired nozzle plate information, a desired deformation information, an actual deformation information or an actual nozzle pate information and an actual information.

3. The device according to claim 2, wherein said actual nozzle plate information and said desired nozzle plate information comprise an image information of said nozzle plate, a temperature information of said nozzle plate, a pressure information of said nozzle plate, a diameter of said nozzle plate, and a grey scale of said nozzle plate.

4. The device according to claim 2, wherein said actual deformation information is a nozzle plate deformation information controlled by said control unit.

5. The device according to claim 2, wherein said desired nozzle plate information and said desired deformation information are inputted and stored in said memory unit.

6. The device according to claim 1, wherein said image capturing unit comprises a flashing light device and a digital signal processor, wherein said flashing light device provides a light source to said image capturing unit, and said digital signal processor processes an image to capture an actual droplet image information or an actual nozzle information.

7. The device according to claim 1, wherein said color for said light source of flashing light device is selected from the group consisting of red, green, blue, white, and their any combination.

8. The device according to claim 1, wherein said light source of flashing light device is selected from the group consisting of light emitting diode, magnesium light and tungsten light.

* * * * *